US007495159B1

(12) United States Patent
Takegawa et al.

(10) Patent No.: US 7,495,159 B1
(45) Date of Patent: Feb. 24, 2009

(54) REFLECTING PLATES FOR RESONATING CHAMBER

(75) Inventors: Akito Takegawa, Chiba (JP); Takayuki Nishizawa, Chbia (JP)

(73) Assignee: Pearl Musical Instruments Co., Chiba (JP)

( * ) Notice: Subject to any disclaimer, the term of this patent is extended or adjusted under 35 U.S.C. 154(b) by 0 days.

(21) Appl. No.: 11/926,313

(22) Filed: Oct. 29, 2007

(51) Int. Cl.
*G10D 13/02* (2006.01)

(52) U.S. Cl. ..... 84/411 R

(58) Field of Classification Search ..... 84/411 R, 84/411 M

See application file for complete search history.

(56) References Cited

U.S. PATENT DOCUMENTS

| | | | | |
|---|---|---|---|---|
| 423,060 | A | 3/1890 | Legault | |
| 1,664,547 | A * | 4/1928 | Greenop | 84/271 |
| 2,837,002 | A | 6/1958 | Susser | |
| 3,724,313 | A | 4/1973 | Frigo et al. | |
| 4,026,185 | A | 5/1977 | Migirian | |
| 4,048,895 | A | 9/1977 | May | |
| 4,170,162 | A | 10/1979 | Casavant | |
| 4,731,141 | A * | 3/1988 | Thirion | 156/171 |
| 4,790,228 | A | 12/1988 | Thirion | |
| 4,858,510 | A | 8/1989 | Shimoda et al. | |
| 2002/0092406 | A1 | 7/2002 | Hagiwara | |
| 2006/0156898 | A1 | 7/2006 | Nickel | |

* cited by examiner

*Primary Examiner*—Kimberly R Lockett
(74) *Attorney, Agent, or Firm*—Berenato, White & Stavish

(57) ABSTRACT

A sound enhancement system for resonating chambers, in particular for drums, is provided. Specifically, at least one reflection plate is added within the drum cylinder whereby the reflection plate(s) vibrate sympathetically to add pleasing frequencies to the sound when a drum or other resonating chamber is struck. The reflecting plate(s) are preferably metallic elements mounted to the drum via the screws that attach the lugs. In the preferred embodiment, the reflecting elements are formed as tent-like or prism-shaped members that are mounted to vibrate within the resonating chamber. Other shapes are envisioned for the resonating elements.

11 Claims, 4 Drawing Sheets

REFLECTING PLATES FOR RESONATING CHAMBER

BACKGROUND OF THE INVENTION

1. Field of the Invention

The present invention relates generally to an improved resonating chamber and, in particular, to a sound attenuating system for use with drums and other acoustic articles.

2. Description of Prior Art

An instrument used for projecting, transmitting, and/or enhancing sound typically includes a solid body with a hollow cavity and a resonating element, such as a membrane, a string, or a diaphragm. For example, a drum can be made with an animal skin or synthetic film stretched over an open end of a hollow body. When a user strikes the resonating element, the vibration of the resonating element produces a sound that is characteristic of the instrument. Many factors can influence the sound produced. These factors include, for example, the types of materials used for the body and for the resonating element, the shape of the body, and the addition of other components. For example, a snare can be added to the membrane or the body of a drum to further enhance the sound. Typically, a user can tune the instrument by adjusting the tension applied to the resonating element. However, the tuning range is rather limited. Furthermore, the ability of the instrument body to project, transmit, and/or enhance sound is rather limited due to the destructive interference of sound waves carried by the instrument body. Accordingly, there is a need for improving the tunable range of the instrument and the ability of the instrument body to project, transmit, and/or enhance sound.

It is well established that different metals vibrate at different frequencies. Differences in various metals can be felt in the weight and flexibility, and heard from the differences in resonant frequency, harmonics, and dampening of the different tuning forks. Table I below shows various properties of a number of metals and other materials.

TABLE I

| Trade Name | E (GPa) | Density ρ (g/cm$^3$) | Liquidus Temp. (° C.) | Composition | Frequency (Hz) |
|---|---|---|---|---|---|
| Poly-carbonate | 2.0 | 1.2 | — | C H | — |
| Pure tin | 49.9 | 7.28 | 232 | Sn 99.9% | — |
| Zn | 104.5 | 7.1 | 420 | Zn 95% | (d) |
| Free cutting brass 360 | | 8.50 | 930-950 | 60Cu-37Zn-3Pb | 129 |
| Yellow brass (cartridge) | 100.6 | | 930-950 | 70Cu-30Zn | 156 + 950 |
| Copper 110 | 129.8 | 8.94 | 1,084 | Cu 99% | 190 |
| CDA 954, Al-Bronze | | | 550-640 | Cu-11Al-4Fe-2.5maxNi | 190 + 1,400 (d) |
| Zr 702 | 98 | 6.51 | 1,855 | Zr-4.5maxHf | 200 + 1,250 |
| Brush alloy 190 | 131 | 8.25 | 880-950 | Cu-1.9Be | 206 + 1,400 |
| Monel 400 | 185 | 8.83 | 1,300 | 65Ni-30Cu-1Mn-1.5Fe | 233 |
| AZ31 | 44.7 | 1.78 | 600-640 | Mg-3Al-1Zn | 255 (d) |
| Ti grade 2 | 120 | 4.51 | 1,665 | Ti-max: 0.25 O-0.3Fe-0.1C-0.03Ni-0.015H | 2.56 + 1,630 |

TABLE I-continued

| Trade Name | E (GPa) | Density ρ (g/cm$^3$) | Liquidus Temp. (° C.) | Composition | Frequency (Hz) |
|---|---|---|---|---|---|
| Stainless 303 | 193 | 8.0 | 1,400-1,420 | Fe-18Cr-9Ni-2Mn-1Si-0.15C-0.6Mo-max:0.2P-0.15S | 260 |
| Inconel 625 | 208 | 8.44 | 1,290 | Ni-22Cr-9Mo-4Nb-0.3Ti-0.3Al | 260 + 1,400 |
| 6061-T6 | 68.9 | 2.70 | 575-630 | Al-1.0Mg-0.6Si-Mn | 260 + 1,600 |
| A6 tool steel (hard) | 200 | 7.84 | 1,530 | Fe-2.2Mn-1.2Mo-1.1Cr-0.7C | 266 |
| 1018 steel | 350-490 | 7.9 | 1,500-1,530 | Fe-0.18C-0.7Mn | 267 + 1,666 |
| A6 tool steel (soft) | >200 | ~7.84 | 1,450 | Fe-2.2Mn-1.2Mo-1.1Cr-0.7C | 276 |

By way of example, tuning forks made by the forgoing materials produce a distinctive ring. The dense copper alloys have a lower pitch, while the stiff steel alloys have a higher pitch. One can hear clear differences between brass, bronze, copper, and copper-beryllium. The free machining brass with 3% lead has the lowest pitch. It is known that steel and 6061 aluminum sound similar because steel's threefold increase in stiffness is compensated for by its threefold increase in density. The polycarbonate does not resonate at all, nor does the pure tin because it bends every time it is tapped to resonate. Magnesium, zinc, and aluminum-bronze dampen out within a few seconds. The Monel (Ni—Cu) and the Inconel (Ni—Cr) resonate loud and long. Hardened A6 tool steel resonates at a lower frequency than annealed A6 tool steel. Several metals, including zirconium, titanium, and Inconel, resonate with harmonics. There are almost 100 metallic elements, and when combined, the number of commercial alloys reaches the tens of thousands.

The tone of a tuning fork is a function of the dimensions, the density, and the elastic modulus of the metal from which it is machined. If the dimensions are kept the same, but the metal is changed, then a different frequency will result from the different densities and the elastic moduli.

$$f = k\sqrt{\frac{E}{\rho}} \qquad \text{Equation A}$$

In Equation A, the resonant frequency f is related to the dimensions k, the elastic modulus E, and the density ρ. The density of a metal is a function of its crystal structure and atomic weight. The elastic modulus is a measure of the stiffness of the metal, that is, how tightly the atoms are bound. Metals with strong atomic bonding are not only stiff, but also have high melting points.

It is known to use sound attenuation or modulation for drums and other resonating devices, for example by muffling or altering the drum head tension or by altering the drum beater. However, there is a need for a device or system for adding pleasing frequencies to the sound of a drum or other resonating device when the drum is struck or vibrations are applied to the resonating device.

SUMMARY OF THE INVENTION

The invention enhances the sound of resonating chambers by adding at least one reflection plate to add pleasing frequencies to the resonating chamber. In accordance with the present invention, at least one reflection plate is added within the drum cylinder whereby the reflection plate(s) vibrate sympathetically to add pleasing frequencies to the sound when a drum or other resonating chamber is generating sound.

The apparatus has particular utility in connection with improving the spectrum of sound produced by drums, in particular snare drums, but it also has application to other instruments having a resonating chamber that can project, transmit, or enhance sound.

DETAILED DESCRIPTION OF THE PREFERRED EMBODIMENTS

The present disclosure describes resonating devices having superior tuning ranges and enhanced abilities to project, transmit, and enhance sound. Aspects of the invention are described below in the context of a drum for producing sound. It should be understood that in other embodiments, the resonating devices can include speakers, guitars, microphones or any other devices having a resonating cavity coupled with a resonating element, such as a membrane, a string, a diaphragm, or any other elements capable of producing pulsating air pressures. It will be appreciated that several of the details set forth below are provided to describe the following embodiments in a manner sufficient to enable a person skilled in the relevant art to make and use the disclosed embodiments. Several of the details and advantages described below, however, may not be necessary to practice certain embodiments of the invention. Additionally, the invention can include other embodiments that are within the scope of the claims but are not described in detail with respect to FIGS. 1-6.

Figure 1:
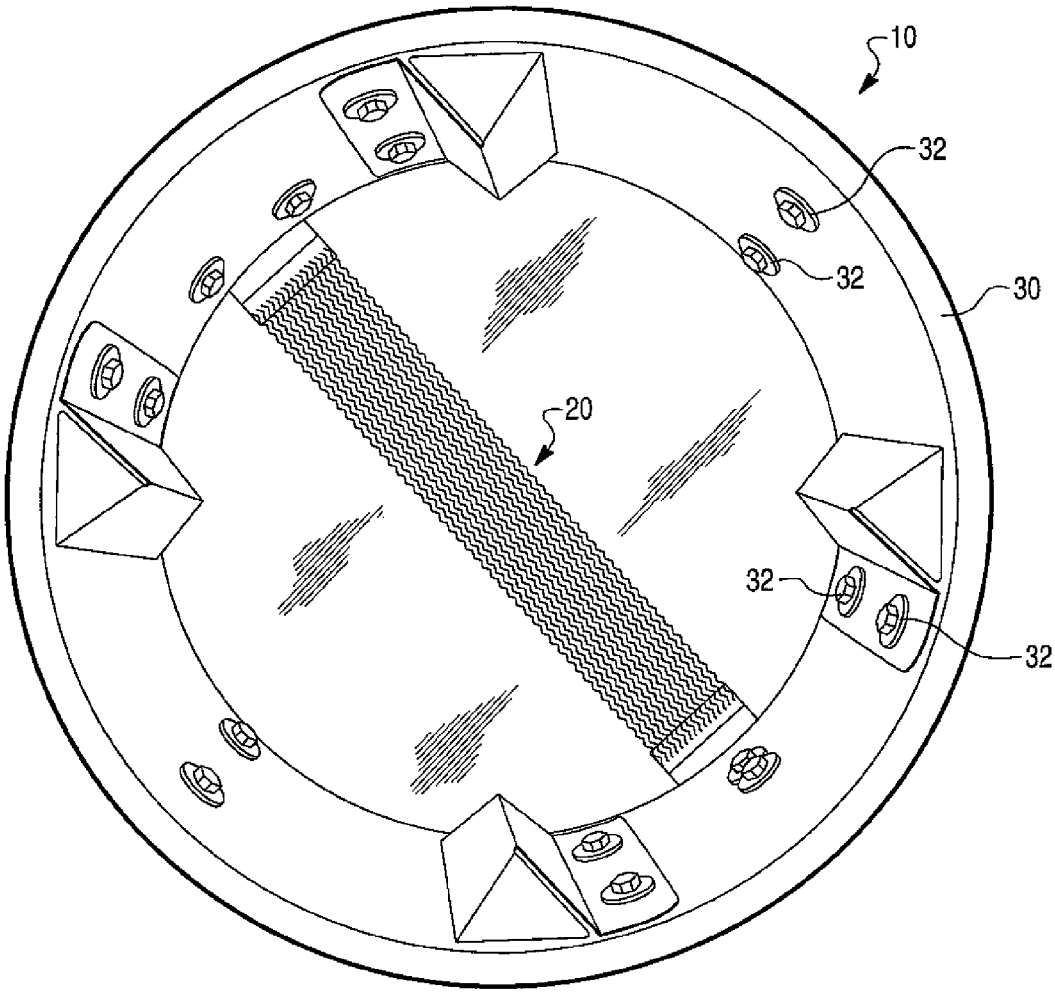
FIG. 1 is a top view of a snare drum incorporating the reflecting plates of the present invention.

One aspect of the disclosed embodiments is illustrated in FIG. 1 and is directed toward a resonating device (e.g., a snare drum for producing sound) 10 that includes a generally planar first portion with a resonating element (e.g., a membrane or skin) that defines a conventional drum head (not shown), second portion 20 opposite the resonating element, and a generally cylindrical body portion or shell 30 between the first portion and the second portion. By way of example, the second portion 20 opposite the resonating element or drum head is shown as a snare assembly mounted on a snare drum in a manner that it is known to those of skill in the art. The second portion 20, however, may consist of an open or closed drum end opposite the drum head.

The drum shell 30 may include lugs typically used to mount the membrane or skin defining the drum head in a manner that permits the drum head to be tensioned. The lugs are mounted to the drum shell 30 by screws 32

In accordance with this invention, at least one resonating plate 40 is mounted to the inner surface of the drum shell 30. In the preferred embodiment, the resonating plate 40 is mounted using the screws 32 typically provided with the lugs of a drum assembly.

Figure 2:
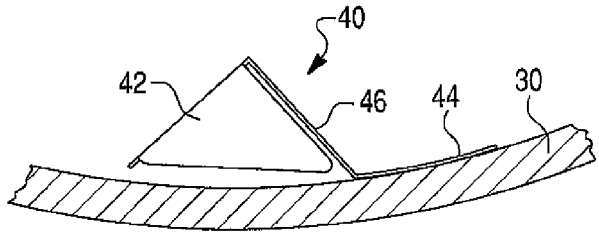
FIG. 2 is an enlarged view of one reflecting plate mounted to a drum shell as shown in FIG. 1.

With reference to FIG. 2, the resonating plate 40 is mounted to the drum shell 30 in a cantilevered manner so that the main body 42 may vibrate relative to the drum shell 30. In the preferred embodiment, the resonating plate 40 is formed with a main body 42, a foot portion 44, and a leg portion 46 therebetween. The foot portion is fixedly secured to the drum shell 30 via lug screws 32. The main body 42 is supported on the drum shell 30 by the foot portion 44, and the wall portion 46 interconnects the foot portion 44 and the main body 42. However, the invention should not be limited to the shape and design illustrated in the drawings since the broad concept of a thin metallic resonating plate is not known in the prior art.

Figure 3:
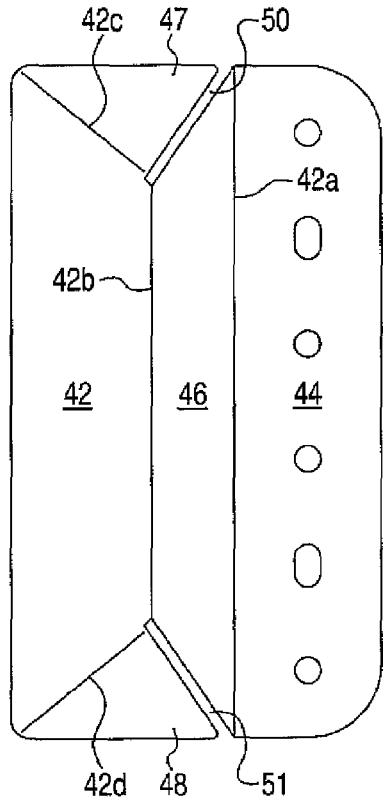
FIG. 3 is a top view of one reflecting plate according to the present invention.
Figure 4:
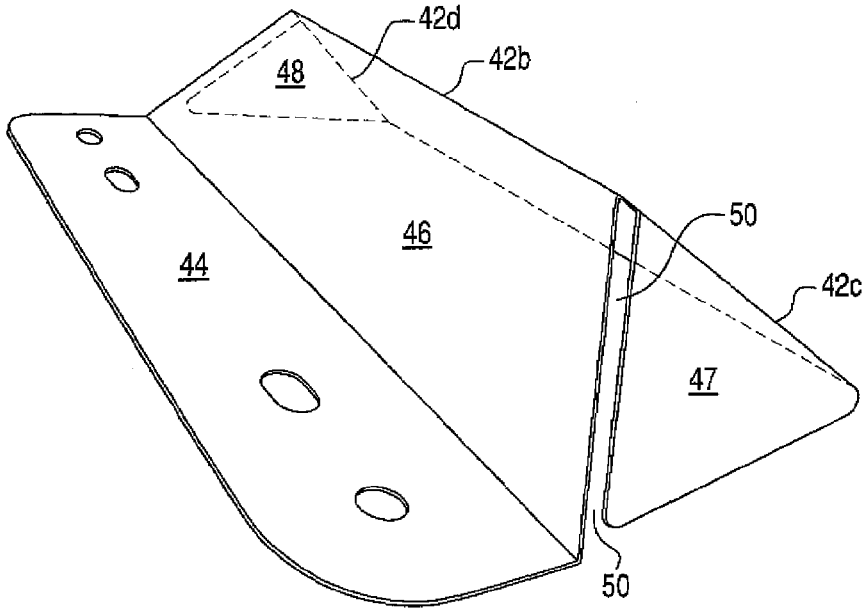
FIG. 4 is a perspective view of the reflecting plate shown in FIG. 3.
Figure 5A:
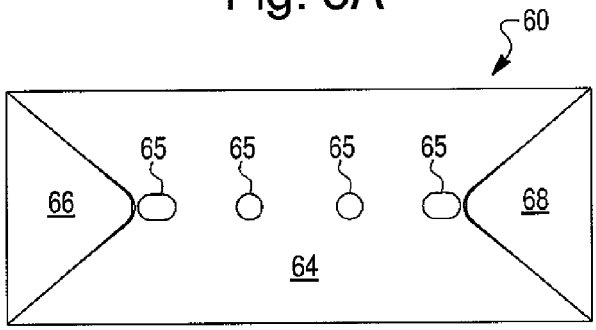
FIGS. 5*a*-5*d* illustrate an alternate embodiment of the resonating plates of the present invention.
Figure 5B:
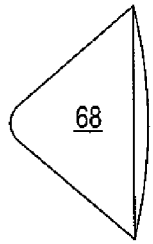
Figure 5C:
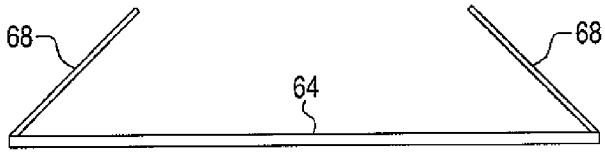
Figure 5D:
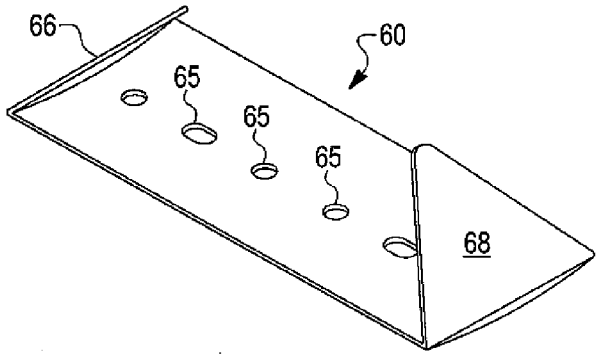
Figure 6A:
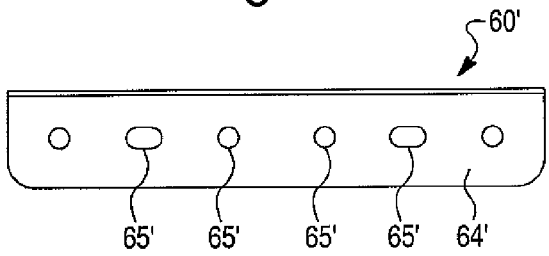
FIGS. 6*a*-6*d* illustrate another alternate embodiment of the resonating plates of the present invention.
Figure 6B:
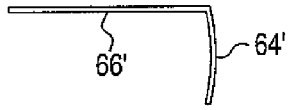
Figure 6C:
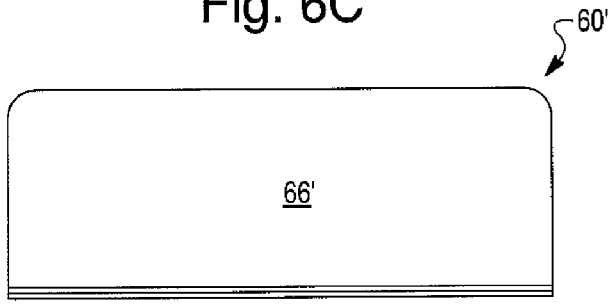
Figure 6D:
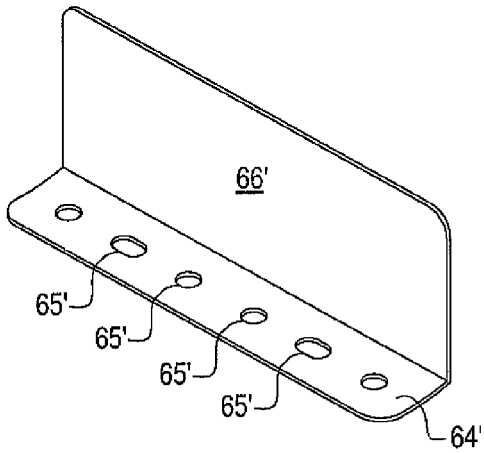

As shown in FIGS. 3 and 4, the main body 42 and leg portion 46 may form a tent-shaped or prism-shaped body by folding or bending a single, thin piece of metal along a first fold line 42*a* between the foot portion 44 and the leg portion 46. Then, the thin piece of metal may be again bent at fold line 42*b*. Lastly, the main portion 42 may be again bent at fold lines 42*c*, 42*d* to form wings 47, 48.

To enhance the resonation characteristics of the resonating plate 40, a gap or slit 50 may be provided between the wings 47, 48 and the leg portion 46.

As is apparent from the foregoing description of the novel features of this invention, the invention enhances the sound of resonating chambers by adding reflection or resonating plates 40 to add pleasing frequencies to the resonating chamber. In accordance with the present invention, reflection or resonating plates 40 are mounted within the drum cylinder 30 with reflection plates 40 that vibrate sympathetically to add pleasing frequencies to the sound when a drum is struck.

In the preferred embodiment, the plates 40 are made of metal (however other materials can be used) and are attached to the inside of drum shells 40 via the screws 32 that attach the lugs to the exterior of the drum shell 30. The amount of sound embellishment depends on the number of reflection plates 40 that are installed up to the total number of lugs on the drum.

The plates 40 can be made of different types of metal such as stainless steel, steel, copper, brass, bronze, etc., each of which vibrates at a different frequency (for example, stainless steel vibrates at a higher frequency than bronze). Depending on the type of metal used, additional high frequencies, middle frequencies or low frequencies can be added to the sound of the drum. The plates 40 can be made in different lengths to accommodate drums of different heights. The reflection surface can be made larger or smaller to fine tune the desired frequency of vibration (smaller=higher frequencies and larger=lower frequencies).

The reflection plates are primarily designed for use with snare drums but can be used on all types of drums.

Referring to the attached drawing FIGS. 2-4, the reflection plates 40 are preferably formed from a single sheet of metal and features an attachment area that sits flush to the drum shell 30 and a tent-like or prism-like structure that is free to vibrate like a tuning fork. Of course, different shapes are envisioned by this invention and the specific shapes shown herein are merely the best mode known to the inventor at the time of filing. For example, FIGS. 5*a*-5*d* illustrate the resonating plate 60 to include a main mounting portion 64 with mounting holes 65 and a pair of resonating wings 66, 68. Alternatively, FIGS. 6*a*-6*d* illustrate the resonating plate 60' to include a main mounting portion 64' with mounting holes 65' and a resonating wing 66' bent at an angle of about 90° with respect to the main mounting portion 64'. The main mounting portions 64, 64' may be curved to match the curvature of the inner surface of the drum shell.

Instead of the lug screws 32, the attachment system can have a multiplicity of holes to accommodate lugs of differing spacing; or the attachment area can have slots for universal attachment to the drum shell or a combination of holes and slots.

While the foregoing invention has been shown and described with reference to a preferred embodiment, it will be understood by those of skill in the art that various changes in form and detail may be made therein without departing from the spirit and scope of the presently claimed invention.

The invention claimed is:

1. A resonating chamber, comprising:

a resonating chamber comprising a shell having an interior surface;

at least one resonating plate mounted to said interior surface for adding frequencies to sound waves propagating within said resonating chamber, wherein said resonating plate is mounted to vibrate within said resonating chamber, and wherein said resonating plate is a flat plate folded along at least one fold line.

2. The resonating chamber according to claim 1, wherein said resonating plate is mounted to said interior surface in a cantilevered manner.

3. A resonating chamber, comprising:

a resonating chamber comprising a shell having an interior surface;

at least one resonating plate mounted to said interior surface for adding frequencies to sound waves propagating within said resonating chamber, wherein said resonating plate is mounted to vibrate within said resonating chamber, and wherein said resonating plate comprises at least two plates having parallel edges separated by a predetermined distance.

4. The resonating chamber according to claim 3, wherein said at least two plates are mounted in a cantilevered manner on said interior surface.

5. The resonating chamber according to claim 1, wherein said resonating plate is at least partially formed into a pyramidal shape.

6. The resonating chamber according to claim 1, wherein said resonating plate is formed of metal.

7. A resonating chamber, comprising:

a resonating chamber comprising a shell having an interior surface;

at least one resonating plate mounted to said interior surface for adding frequencies to sound waves propagating within said resonating chamber, wherein said resonating plate is mounted to vibrate within said resonating chamber, and wherein at least one said resonating plate is a plurality of resonating plates flat plates disposed symmetrically within said resonating chamber.

8. The resonating chamber according to claim 1, wherein said resonating plate defines a prism-like shape that adds frequencies to said resonating chamber during vibration.

9. A percussion instrument, comprising:

a drum shell having an interior surface to define a resonating chamber;

a drum head stretched over an open end of said drum shell;

at least one resonating plate mounted to said interior surface for adding frequencies to sound waves propagating within said resonating chamber when said drum head is struck, wherein said resonating plate is a thin metal plate mounted to vibrate within said resonating chamber, and wherein said resonating plate is a flat plate folded along at least one fold line to define at least one resonating wing extending from said interior surface toward an interior of said drum shell.

10. The percussion instrument according to claim 9, wherein said resonating plate is mounted to said interior surface in a cantilevered manner.

11. A percussion instrument, comprising:

a drum shell having an interior surface to define a resonating chamber;

a drum head stretched over an open end of said drum shell;

at least one resonating plate mounted to said interior surface for adding frequencies to sound waves propagating within said resonating chamber when said drum head is struck, wherein said resonating plate is a thin metal plate mounted to vibrate within said resonating chamber, and wherein at least one said resonating plate is a plurality of resonating plates mounted to said interior surface and disposed symmetrically within said resonating chamber.

* * * * *